US010207724B2

(12) United States Patent
Frenzke et al.

(10) Patent No.: US 10,207,724 B2
(45) Date of Patent: Feb. 19, 2019

(54) METHOD FOR OPERATING A VEHICLE

(71) Applicant: SIEMENS AKTIENGESELLSCHAFT, Munich (DE)

(72) Inventors: Thorsten Frenzke, Erlangen (DE); Sascha Giebel, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/521,980

(22) PCT Filed: Oct. 22, 2015

(86) PCT No.: PCT/EP2015/074505
§ 371 (c)(1),
(2) Date: Apr. 26, 2017

(87) PCT Pub. No.: WO2016/066523
PCT Pub. Date: May 6, 2016

(65) Prior Publication Data

US 2017/0313330 A1 Nov. 2, 2017

(30) Foreign Application Priority Data

Oct. 28, 2014 (DE) ..... 10 2014 221 964

(51) Int. Cl.
*B61L 3/00* (2006.01)
*B61L 15/00* (2006.01)

(52) U.S. Cl.
CPC ..... *B61L 3/006* (2013.01); *B61L 3/004* (2013.01); *B61L 3/008* (2013.01);
(Continued)

(58) Field of Classification Search
CPC ..... B61L 3/006; B61L 3/004; B61L 15/0018
See application file for complete search history.

(56) References Cited

U.S. PATENT DOCUMENTS

2003/0230994 A1 12/2003 Seddiki et al.
2007/0225878 A1 9/2007 Kumar et al.
(Continued)

FOREIGN PATENT DOCUMENTS

CN 1454800 A 11/2003
CN 101356089 A 1/2009
(Continued)

*Primary Examiner* — Michael D Lang

(57) ABSTRACT

A method is provided for operating a vehicle having a drive unit, a driving-data determination unit, a consumer set, and a power management unit for managing the consumer set. The driving-data determination unit identifies or determines driving curve data and the drive unit is controlled on the basis of the driving curve data. The method achieves an optimization with regard to a defined quality criterion while also taking the consumer set into account, in that the power management unit receives consumer data from the consumer set, the power management unit determines anticipatory load profile data at least on the basis of the consumer data, determination or identification data are transmitted to the driving-data determination unit in accordance with the load profile data, and the driving-data determination unit determines or identifies the driving curve data in accordance with the determination data.

11 Claims, 3 Drawing Sheets

(52) U.S. Cl.
CPC ..... *B61L 15/0018* (2013.01); *B61L 15/009* (2013.01); *B61L 15/0036* (2013.01)

(56) References Cited

U.S. PATENT DOCUMENTS

| | | | |
|---|---|---|---|
| 2010/0262321 | A1 | 10/2010 | Daum et al. |
| 2012/0316717 | A1 | 12/2012 | Daum et al. |

FOREIGN PATENT DOCUMENTS

| | | | |
|---|---|---|---|
| DE | 102009023704 | A1 | 10/2010 |
| EP | 1897745 | A2 | 3/2008 |
| WO | 2008073547 | A2 | 6/2008 |

METHOD FOR OPERATING A VEHICLE

BACKGROUND OF THE INVENTION

Field of the Invention

The invention relates to a method for operating a vehicle which has a drive unit, a driving-data determination unit, a consumer set and a power management unit that is provided for managing the consumer set, wherein the driving-data determination unit identifies driving curve data and the drive unit is controlled on the basis of the driving curve data.

In the case of motor-driven vehicles, it is normal practice to strive for minimal energy consumption. So-called driver assistance systems, which output driving recommendations for the vehicle driver, have already been proposed for this purpose. For the purpose of generating these recommendations, for example, so-called driving curves are determined, said driving curves being the result of an optimization of the energy consumption of the drive unit under predetermined framework conditions in respect of a route section profile and a travel time.

With regard to the energy consumption of subsidiary consumer units, this is usually managed by a power management unit (also referred to as "on-board network management").

SUMMARY OF THE INVENTION

The object of the invention is to improve the method to the effect that an optimization can be achieved in respect of a defined quality criterion while also taking the consumer set into account.

In order to achieve this, it is proposed that the power management unit receives consumer data from the consumer set, the power management unit determines anticipatory load profile data at least on the basis of the consumer data, identification data is transmitted to the driving-data determination unit in accordance with the load profile data, and the driving-data determination unit identifies the driving curve data in accordance with the identification data. It is thereby possible advantageously to take a future power requirement of the consumer set into account when identifying driving curve data, wherein a further optimization of a quality criterion can be achieved in comparison with conventional driver assistance systems.

A quality criterion to be optimized is preferably the total energy consumption of the vehicle. It may however consist of another variable such as e.g. the maximum power, the range of the vehicle, the travel time for a given route section, an emission value, in particular a noise emission value or a further variable considered to be applicable by a person skilled in the art. Moreover, the quality criterion can also comprise a combination of a plurality of the cited variables.

A "consumer" is understood to be at least one component for performing a specific consumer function or a combination of components which are provided for the purpose of jointly satisfying a specific consumer function. The "consumer set" comprises at least one consumer, preferably a group of consumers. Therefore the consumer set is assigned at least one consumer function, preferably a plurality of consumer functions. Typical consumer functions include (for example and not exclusively) the air conditioning and/or ventilation of an environment of the vehicle, the generation of compressed air or the charging of an electrical energy store. In technical language, a consumer may also be referred to as an "auxiliary operational unit" or (as compared with the drive unit) a "subsidiary consumer unit". The consumers are preferably electrical components. However, the invention can also be applied to non-electrical consumers, e.g. subsidiary consumer units to which energy is mechanically or thermally supplied by the drive unit.

In order to supply the consumer set with electrical energy, provision is preferably made for a so-called on-board network. If the drive unit is fitted with at least one electric motor and draws electrical energy from an intermediate circuit, the on-board network is preferably supplied with electrical power by means of a power supply unit, in particular in the form of a converter unit, which is connected to the intermediate circuit.

For the purposes of the invention, a management process of the power management unit which is assigned to the consumer set comprises at least the determination of a power that is available for the consumer set or an assigned on-board network, and the initiation of control processes of the consumer set such that the operation of the consumer set is adapted to this power. If the consumer set comprises a group of consumers, these control processes initiated by the power management unit advantageously serve to distribute the available power over the consumers of the set.

A "driving curve" is intended to signify in particular the course of a dynamic parameter of the vehicle relative to a position parameter. This position parameter is used to identify the position of the vehicle along a route section that is to be traveled and is known in advance. It can take the form of a location parameter, e.g. a distance from a route section start/end, or a route section kilometer/hectometer, or a time. The dynamic parameter, which is plotted relative to the position parameter, can be the acceleration or the speed of the vehicle, a tractive force or braking force, or a traction output or braking power. A driving curve is preferably identified by the specification of a sequence of operating phases. In particular, possible operating modes for an operating phase are accelerating, maintaining speed, coasting, braking and standstill. In this case, a coasting phase and a braking phase can be combined under the generic term of "slowing phase", in which the speed of the vehicle decreases. An operating phase is defined at least by the specification of an operating mode and at least one value of the position parameter, said value identifying at least the start of the operating phase in particular. A range of the position parameter, in particular a duration, can advantageously be specified for the operating phase. An acceleration phase and a braking phase can also be further characterized respectively by an acceleration value or a braking effect, e.g. in the form a braking power or a braking force.

For the purposes of the invention, the determination of driving curve data is based on at least one optimization method. This optimization takes place under predetermined framework conditions relating to a route section profile and a timetable. Route section data and timetable data are therefore advantageously configured as input data for the optimization method. Driving curve data, which is determined by the driving-data determination unit, is preferably the result of an optimization of at least the energy consumption of the drive unit.

The drive unit can be controlled on the basis of the driving curve data, in that said data is used for the purpose of automatic control by a control unit, or is used to generate driving recommendations to be output to the vehicle driver. In the latter case, the drive unit is controlled manually by the vehicle driver with reference to the driving recommendations that were generated on the basis of the driving curve data.

A "load profile" is intended to signify in particular the course of at least one consumer parameter relative to the position parameter, preferably relative to a travel time. The consumer parameter takes the form of a power parameter in particular. "Anticipatory" load profile data is data of a future load profile which relates to a route section that is yet to be traveled. The load profile data preferably relates to the total power requirement of the consumer set or of an assigned on-board network, wherein the determination of load profile data for the respective power requirement of individual consumers is likewise conceivable.

According to an advantageous development of the invention, it is proposed that the identification data transmitted to the driving-data determination unit corresponds to the load profile data, and that the driving-data determination unit determines the driving curve data in accordance with the load profile data. In this embodiment, the identification of the driving curve data by the driving-data determination unit comprises the determination of said data on the basis of the load profile data. In this way, the anticipatory load profile data determined by the power management unit is appropriately used as input data of an optimization method performed by the driving-data determination unit.

In a further embodiment variant of the invention, it is proposed that the driving-data determination unit determines data sets comprising alternative driving curve data, the data sets are transmitted to the power management unit, one of the data sets is selected in accordance with the load profile data, and the identification data is characteristic of the selected data set. In a first step of this embodiment, provision is appropriately made for determining data sets which are results of an optimization of an energy consumption of the drive unit. In this case, the functionality of the power management unit advantageously comprises the determination of the data set which results in a minimal energy requirement for the consumer set. This energy requirement is preferably the total energy requirement of the consumer set. The total energy requirement for traction and consumer set or on-board network can therefore be optimized by the selection of the suitable data set. The identification data appropriately comprises at least an information content which is sufficient for the driving-data determination unit to identify the data set that is to be applied for the purpose of controlling the drive unit.

It is moreover proposed that the data sets comprising alternative driving curve data are determined for a specific route section that is to be traveled under the condition of a predetermined travel time. This allows an optimization to take place while complying with framework conditions relating to a timetable.

According to an advantageous development of the invention, it is proposed that, during the identification of the driving curve data by the driving-data determination unit, slowing curve data is identified in accordance with the identification data. This is suitable in particular for a configuration of the drive unit which has at least one electrical braking mode, in which as part of a braking process the kinetic energy of the vehicle is converted into electrical energy which can be used for operation of the consumer set. Of the various operating phases, a slowing phase in this context has a significant influence on an energy which is available for the operation of the consumer set, since in this phase no electrical energy is drawn by the drive unit or the kinetic energy of the vehicle is converted into electrical energy. However, regenerative braking is usually characterized in that a significant amount of power is released by the drive unit within a short duration. If no means or only limited means are provided for return feed into a supply network and the braking energy cannot be used or temporarily stored in the vehicle, it must be converted into heat. It is therefore particularly advantageous if the load profile data of the power management unit is taken into account when identifying slowing curve data, in particular braking curve data, and a slowing phase, in particular a braking phase of the vehicle, is therefore optimized with regard to the energy consumption of the consumer set.

If data sets comprising alternative driving curve data are determined as described above, it is proposed in this context that the respective driving curve data of the data sets differs at least in respect of slowing curve data. In particular, an optimization of the processing power when determining the driving curve data can be achieved if the determination of driving curve alternatives is selectively directed at a slowing phase, in particular a braking phase of the vehicle. In a particular embodiment, the respective alternative driving curve data can differ exclusively in respect of slowing curve data.

It is alternatively or additionally possible during the identification of the driving curve data by the driving-data determination unit to identify acceleration curve data in accordance with the identification data. In particular, this is advantageous in an embodiment in which the quality criterion to be optimized comprises at least the maximum power of the vehicle.

It is moreover proposed that at least one of the following operating phases can be controlled on the basis of the slowing curve data: coasting phase, braking phase according to a first braking effect stage, braking phase according to an at least second braking effect stage. In this case, a parameter for the braking effect can be a braking force or a braking power. In this case, a braking effect stage can correspond to a stage which can usually be adjusted by the vehicle driver by means of an operating element.

According to an advantageous embodiment of the invention, it is proposed that the consumer set has at least one charging unit for charging an energy store of the vehicle, wherein the power management unit receives energy status data from the energy store and determines the anticipatory load profile data on the basis of at least the consumer data and the energy status data. The load profile, which is taken into account when identifying the driving curve data, can therefore take into account an energy that is available in the energy store. Depending on the charge status of the energy store, the possibilities for drawing energy from the energy store or feeding energy into the energy store by means of the charging unit can be taken into account when determining the load profile.

The load profile data determined by the power management unit can relate to an anticipated consumption of the consumer set, wherein said anticipated consumption may differ from an actual consumption. However, in an advantageous embodiment, the load profile data is data of a prescribed load profile of the consumer set. Moreover, it is proposed that the consumer set is controlled according to the load profile data.

In particular, the invention is suitable for vehicles for which progress can be predicted over significant time periods in the form of a driving curve. In particular, this means time periods of more than a minute, in particular more than five minutes, and most preferably more than ten minutes. The inventive method can therefore be applied advantageously to road vehicles which use a route section that is little used by other vehicles or is exclusively reserved during the time period. It can be applied particularly advantageously to rail-borne vehicles, particular on regional or mainline railroads for the transportation of people or goods.

The invention further relates to a vehicle having a drive unit, a driving-data determination unit for identifying driving curve data, a consumer set and a power management unit for managing the consumer set, wherein the drive unit can be controlled on the basis of the driving curve data.

It is proposed that the power management unit has a data connection to the consumer set and is provided for the purpose of determining anticipatory load profile data at least on the basis of consumer data of the consumer set, that provision is made for a connection between the power management unit and the driving-data determination unit, via which identification data can be transmitted to the driving-data determination unit in accordance with the load profile data, and that the driving-data determination unit is provided for the purpose of identifying the driving curve data in accordance with the identification data. By virtue of the proposed data communication from the power management unit to the driving-data determination unit, the power requirement of the consumer set can advantageously be taken into account when identifying driving curve data, wherein a further optimization of a quality criterion can be achieved in comparison with conventional driver assistance systems. With regard to the further advantageous effects of the proposed vehicle, reference is made to the foregoing observations in respect of the inventive method.

BRIEF DESCRIPTION OF THE SEVERAL VIEWS OF THE DRAWING

Exemplary embodiments of the invention are explained below with reference to the drawings, in which.

DESCRIPTION OF THE INVENTION

Figure 1:
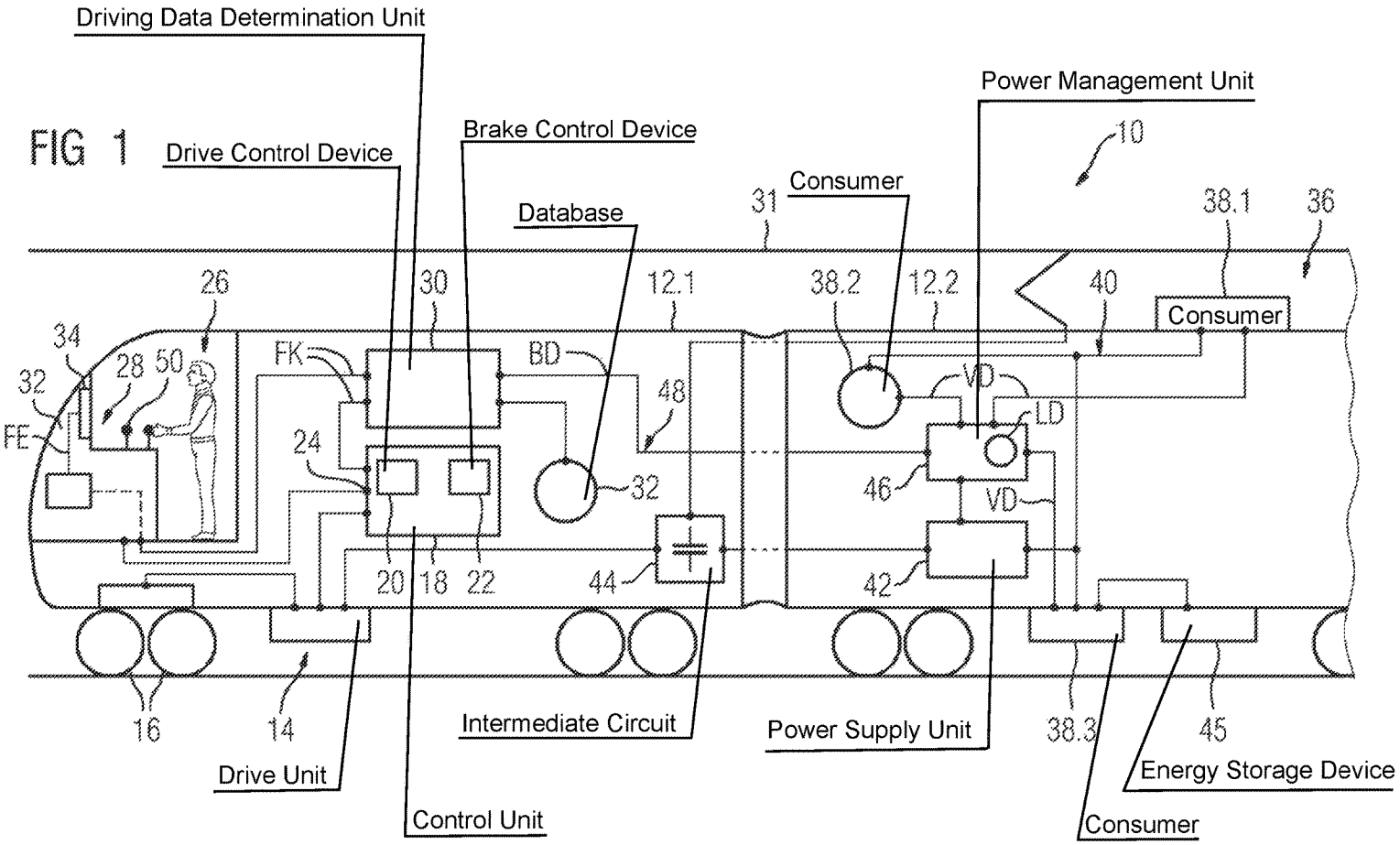
FIG. 1: shows a rail-borne vehicle comprising a driving-data determination unit for identifying driving curve data, a consumer set and a power management unit.

FIG. 1 shows a vehicle which is configured as a rail-borne vehicle 10 in a schematic side view. Said vehicle is configured as a formation of cars 12, the technical term for this being a "multiple unit". The formation is equipped with a drive unit 14 comprising electric traction motors (not illustrated in detail) which are each used to drive at least one drive axle 16. The number of cars and the sequence of the drive axles and carrying axles are exemplary. In the present embodiment, the rail-borne vehicle 10 forms an operationally indivisible train unit, which can be operated in coupled mode with at least one rail-borne vehicle of the type in question, wherein the components of the drive unit 14 are distributed over the formation. It is also conceivable for the composition to comprise traction cars which can be separated from each other and contain an autonomous drive unit 14 in each case, and cars without drive, and be assembled as required. It is also conceivable for the rail-borne vehicle 10 to be configured as a locomotive.

The drive unit 14 can be operated in a traction mode and an electrical braking mode. In order to achieve this, provision is made for a control unit 18 which comprises a drive control device 20 and a brake control device 22. The control unit 18 has an interface 24 to an input device 28 which is arranged in a cab 26. Said input device 28 has operating elements 50 as usual, these being attached to a so-called operating console 32. These operating elements 50 allow commands to be input for the drive unit 14, e.g. a desired traction stage or a desired braking effect stage, said commands being implemented by the corresponding control devices 20, 22 of the control unit 18.

The rail-borne vehicle 10 also has a driving-data determination unit 30, which is provided for the purpose of identifying driving curve data FK. In technical language, the driving-data determination unit 30 is also referred to as a "driver assistance system". The function of the driving-data determination unit 30 is based on at least one optimization method which serves to minimize the energy that is drawn from an external power supply 31 during a journey. This optimization takes place under predetermined framework conditions relating to at least one route section topology which is known in advance and a timetable. Corresponding data which can be used by the driving-data determination unit 30 to perform the optimization method is stored in a database 32. In the present embodiment, the database 32 is arranged on board the rail-bound vehicle 10, wherein at least part of the database can conceivably be arranged on the land side likewise. The driving-data determination unit 30 determines driving curve data FK at least on the basis of this data. This driving curve data FK corresponds to data of a profile of the vehicle speed V plotted relative to the time T, said profile being divided into different operating phases. Possible operating phases in this context are: acceleration phase A, maintaining speed phase B, coasting phase C, braking phase D and standstill phase E. The operating phases "coasting phase" C and "braking phase" D belong to a superordinate "slowing phase" VP. The operating phases "acceleration phase" and "braking phase" can also be divided into further operating phases which relate to the traction effect or braking effect respectively. This is explained in further detail below.

Figure 2:
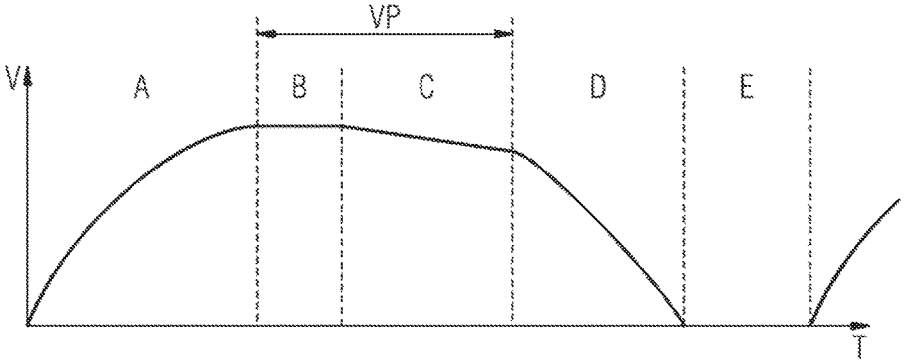
FIG. 2: shows an exemplary driving curve.

An example of such a profile is shown in FIG. 2. Alternatively or additionally, a profile of the vehicle speed V relative to the location or the vehicle position can be formed on the basis of the driving curve data FK.

Driving curve data FK which is determined by the driving-data determination unit 30 serves to control the drive unit 14. According to a first control mode, driving recommendations FE are generated on the basis of the driving curve data FK and are output to the vehicle driver by means of an output unit 34. In a typical embodiment, the output unit 34 is configured as a display unit, an alternative or additional acoustic output being conceivable. The vehicle driver can input commands via the operating elements 50 manually on the basis of the driving recommendations, said commands being implemented by the control unit 18. In a second control mode, commands for the drive unit 14 are generated on the basis of the driving curve data FK and are implemented automatically by the control unit 18. The driving-data determination unit 30 and the control unit 18 are linked by a data connection for this purpose.

The rail-borne vehicle 10 also has a set 36 of electrical consumers 38. These differ from the components of the drive unit 14 and are also referred to as "subsidiary consumer units" or "auxiliary operational units", which are connected to the so-called on-board network 40 as illustrated highly schematically in FIG. 1. This on-board network 40 is typically fed by means of a power supply unit 42 with power from an intermediate circuit 44 to which the drive unit 14 is connected. The power supply unit 42 is typically equipped with at least one power converter, also referred to as an "on-board network converter" or "auxiliary supply converter".

By way of example, FIG. 1 shows electrical consumers 38.1, 38.2 and 38.3 of the set 36, these being respectively configured as air-conditioning system, ventilation unit and charging unit of an energy store 45. A power management unit 46 is provided in order to manage the power for the consumer set 36. This power management unit 46 is used to calculate the total power (or "on-board network power") that is available for the operation of the consumer set 36 and to distribute a power (at most this total power) over the electrical consumers 38. The power management unit 46 has a data connection to the electrical consumers 38 for this purpose, and receives consumer data VD of the electrical consumers 38 via this connection. This consumer data VD serves to characterize the power requirement of a corresponding electrical consumer 38. In addition to this data capture, the power management can comprise the generation of commands for controlling the electrical consumers 38, said commands being implemented by a corresponding consumer controller. In the present embodiment, the power management unit 46 is configured as a central unit in the rail-borne vehicle 10, and is connected to local consumer controllers (not shown). These local consumer controllers can each be responsible for a different consumer 38 or for a superordinate group of consumers 38, e.g. for the electrical consumers 38 of a car 12 in each case. According to a further embodiment, the consumer controllers can also be operated in a master-slave relationship, wherein the previously described function of the power management unit 46 is performed by one of the consumer controllers.

The power management unit 46 is also provided for the purpose of calculating an anticipatory load profile on the basis of the consumer data VD. In order to achieve this, the power management unit 46 calculates in advance the power requirement of the consumers 38 for at least one time period. In this case, use is made of the knowledge obtained from the consumer data VD in respect of which consumers 38 are permanently connected or disconnected during the time period, which are switched at random, and which can be switched on or off under control, and what power is expected in each case. On the basis of the consumer data VD, the power management unit 46 can therefore determine load profile data LD, by means of which it is possible to create a load profile as a power curve plotted relative to the time for the future time period.

In the electrical braking mode, the traction motors of the drive unit 14 are used in a known manner as generators, which feed an electrical energy into the intermediate circuit 44. The driving technique, in particular the various operating phases of the rail-bound vehicle 10, therefore influence the energy that is available for the operation of the consumer set 36. A connection 48 is advantageously provided between the power management unit 46 and the driving-data determination unit 30, and a data flow from the power management unit 46 to the driving-data determination unit 30 is established on said connection during operation. The connection 48 is illustrated schematically in FIG. 1. This can be a direct physical connection or a logical connection which is established over a data bus (not shown). The data flow can take place directly between the power management unit 46 and the driving-data determination unit 30 or via further intermediate units.

This connection 48 is used to transmit identification data BD, generated on the basis of the load profile data LD, to the driving-data determination unit 30. This identification data BD is used by the driving-data determination unit 30 to identify the driving curve data FK. Two examples are described with reference to the FIGS. 3 to 5, wherein the type of the identification data BD and the identification of the driving curve data FK by the driving-data determination unit 30 are explained for each example.

Figure 3:
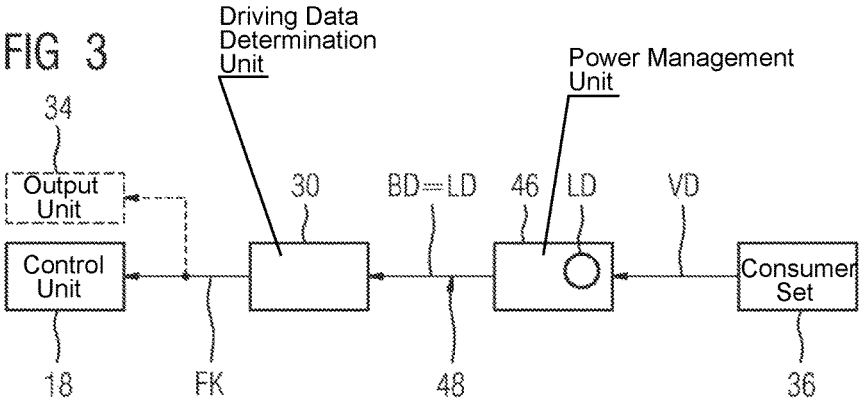
FIG. 3: shows the determination of driving curve data on the basis of load profile data of the power management unit.

A first example is shown in FIG. 3. As described above, consumer data VD of the consumer set 36 is received by the power management unit 46, which uses said data as a basis for determining anticipatory load profile data LD. In the present embodiment, this load profile data LD represents the identification data BD, which is transmitted to the driving-data determination unit 30 via the connection 48. By this means, information relating to the future load profile of the consumer set 36 is transferred to the driving-data determination unit 30. The optimization method of the driving-data determination unit 30 then determines the driving curve data FK on the basis of the load profile data LD. As a result, the course of the power requirement of the consumer set 36 is taken into account when determining the optimal driving curve. In particular, one or more braking phases D are identified in such a way that a maximum power requirement of the consumer set 36 is satisfied by the energy that is generated in the electrical braking mode of the drive unit 14. For example, if an increased power requirement is anticipated for a specific time period, an electrical braking phase D should preferably take place in this time period and with a compatible braking effect. During its identification phase, the driving-data determination unit 30 determines driving curve data FK which takes this into account. The driving curve data FK is passed to the control unit 18 for the automatic control of the drive unit 14, or processed for the output unit 34 for the purpose of outputting driving recommendations.

A second example is explained with reference to the FIGS. 4 and 5. This differs from the previous example in that the driving-data determination unit 30 determines data sets comprising alternative driving curve data FK1, FK2 and FK3. The corresponding driving curves are illustrated in the upper diagram of FIG. 5. The driving curve data FK1, FK2, FK3 differs in each case by virtue of its respective slowing phase VP, in which the vehicle speed V decreases. In the case of the first driving curve, based on the driving curve data FK1, a coasting phase C is initiated at a time point $t_1$. In the case of the second driving curve, based on the driving curve data FK2, the maintaining speed phase B is continued at a constant speed $V_{max}$ until a later time point $t_2$, at which a braking phase Da having a first braking effect is initiated. In the case of the third driving curve, based on the driving curve data FK3, the maintaining speed phase B is continued at constant speed $V_{max}$ until an even later time point $t_3$, at which a braking phase Db having a second braking effect is initiated. The second braking effect is greater than the first braking effect.

The coasting phase C according to the driving curve data FK1 takes place until a time point $t_4$ after the time point $t_3$ and is followed by a braking phase Dc having a third braking effect, which is greater than the second braking effect.

Figure 5:
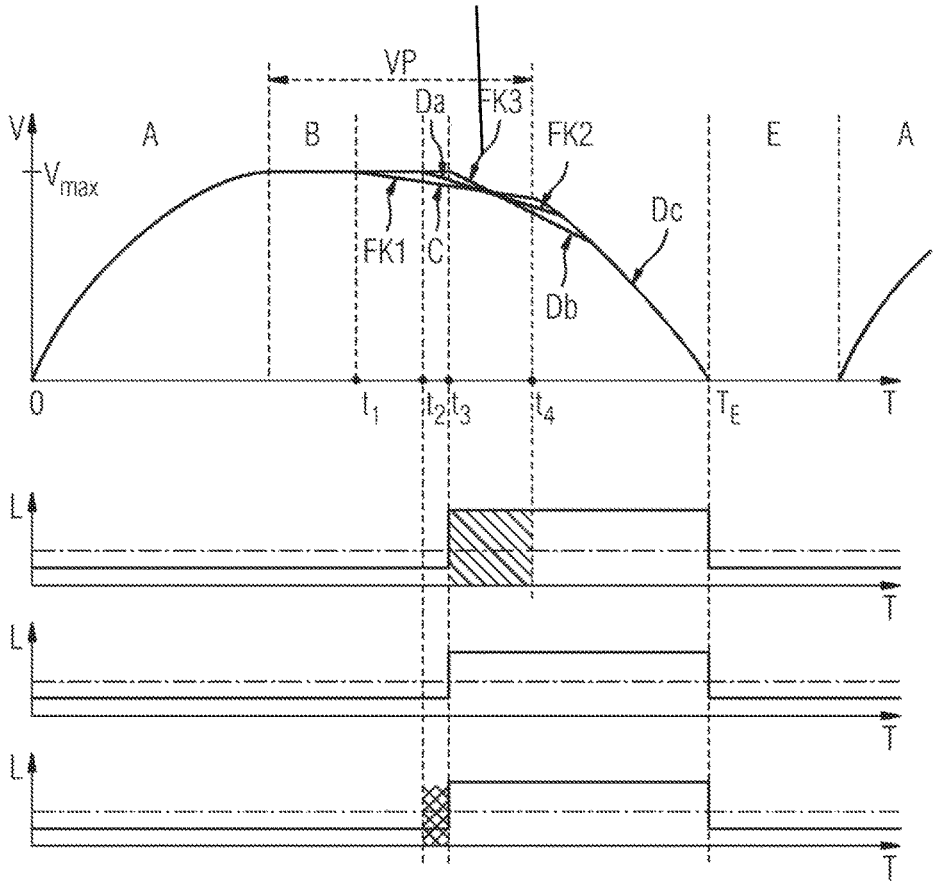
FIG. 5: shows driving curves corresponding to the alternative driving curve data, relative to a load profile of the consumer set.

It is also evident from the upper diagram in FIG. 5 that the data sets comprising alternative driving curve data FK1, FK2, FK3, in particular alternative slowing phases VP, are determined for a specific route section to be traveled under the condition of a predetermined travel time $T_E$.

Figure 4:
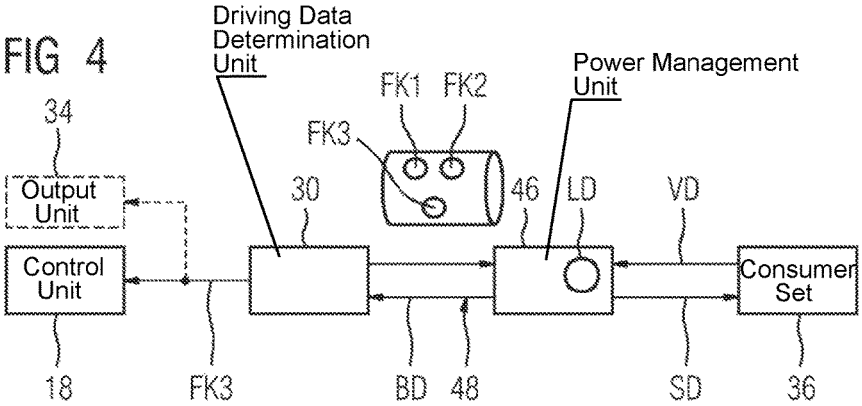
FIG. 4: shows the determination of alternative driving curve data and the selection of an alternative on the basis of the load profile data.

As illustrated in FIG. 4, the data sets comprising the alternative driving curves FK1, FK2, FK3 are transferred via the data connection 48 to the power management unit 46. As described above, this determines the anticipatory load profile data LD on the basis of the consumer data VD. The load profile of the consumer set 36 resulting from the load profile data LD is illustrated in the lower diagram of FIG. 5. In this diagram, the power L that is drawn by the consumer set 36 in each case is plotted relative to the time T. The load profile is characterized by a rise in the power L, said rise being calculated in advance, at the time point $t_3$ until the time point $T_E$ of the standstill. The power management unit 46 determines which driving curve data FK1, FK2, FK3 has the greatest compatibility with the load profile.

In the case of the first driving curve data FK1, a coasting phase C takes place from the time point $t_1$ until the time point $t_4$, at which it is followed by the braking phase Dc. Therefore the electrical energy generated from the depletion of the kinetic energy can only be used for the operation of the consumer set 36 after the time point $t_4$. In the time period between $t_3$ and $t_4$, the electrical power must be drawn from a further source, e.g. from an energy store and/or from the power supply 31. This power is shown by means of hatching in the first of the central diagrams.

In the case of the second driving curve data FK2, a braking phase Da is initiated at the time point $t_2$ before the time point $t_3$. Since the energy requirement of the consumer set 36 is low at the time point $t_2$, some of the regeneratively generated braking energy must be depleted in a braking resistance in case a return feed into the network is not possible. This is shown by the crosshatched region in the bottom diagram of FIG. 5.

In the case of the third driving curve data FK3, initiation of the braking phase Db takes place at the time point $t_3$, at which the power requirement of the consumer set 36 rises. The driving curve data FK3 is therefore selected by the power management unit 46 as optimal driving curve data. This selection is communicated to the driving-data determination unit 30, specifically by the transmission of identification data BD. Said identification data is sufficient to allow the driving-data determination unit 30 to identify the selected data set on the basis of the identification data BD. In a simple embodiment, the selected data set is indicated by a code, which is transmitted to the driving-data determination unit 30 as identification data BD for the purpose of identification by the driving-data determination unit 30. In an embodiment variant, the selected data set can be transmitted at least partially as identification data BD of the driving-data determination unit 30.

As described above, the driving curve data FK is passed to the control unit 18 for the automatic control of the drive unit 14 and/or processed for the output unit 34 for the purpose of outputting driving recommendations.

As illustrated in FIG. 4, control of the consumer set 36 is also performed by the power management unit 46. The power management unit 46 generates control data SD, which is transmitted to corresponding consumer controllers. The corresponding control commands are identified in such a way that the consumer set 36 is controlled as far as possible in accordance with the anticipatory load profile that has been determined.

Figure 6:
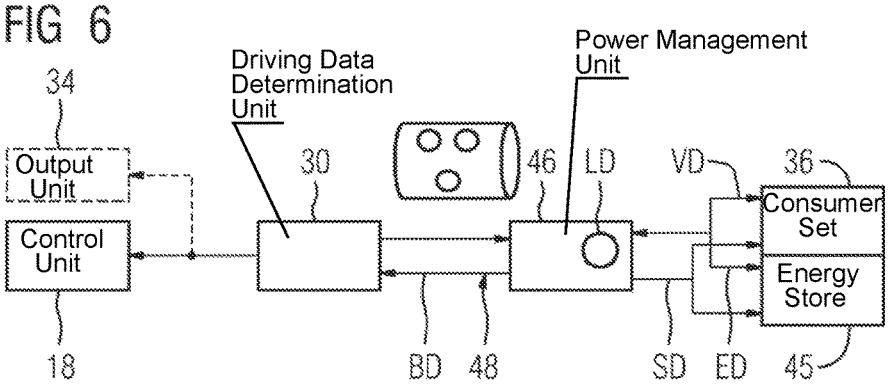
FIG. 6: shows the determination of driving curve data on the basis of load profile data of the power management unit, taking energy status data of an energy store into account.

A further embodiment variant is illustrated in FIG. 6. It differs from the embodiments described above in that the power management unit 46 receives energy status data ED of the energy store 45 and takes it into account when determining the load profile data LD.

The invention claimed is:

1. A method for operating a vehicle, the method comprising the following steps:

providing a vehicle having a drive unit, a driving-data determination unit, a consumer set and a power management unit for managing the consumer set;

using the driving-data determination unit to identify driving curve data;

controlling the drive unit based on the driving curve data;

using the power management unit to receive consumer data from the consumer set;

using the power management unit to determine anticipatory load profile data at least based on the consumer data;

transmitting identification data to the driving-data determination unit in accordance with the load profile data;

using the driving-data determination unit to identify the driving curve data in accordance with the identification data;

using the driving-data determination unit to determine data sets including alternative driving curve data;

transmitting the data sets to the power management unit;

selecting one of the data sets in accordance with the load profile data; and the identification data being characteristic of the selected data set.

2. The method according to claim 1, wherein the identification data transmitted to the driving-data determination unit corresponds to the load profile data, and the driving-data determination unit determines the driving curve data in accordance with the load profile data.

3. The method according to claim 1, which further comprises determining the data sets, including the alternative driving curve data, for a specific route section to be traveled under a condition of a predetermined travel time.

4. The method according to claim 1, which further comprises identifying slowing curve data in accordance with the identification data during the identification of the driving curve data by the driving-data determination unit.

5. The method according to claim 1, wherein respective driving curve data of the data sets differ at least with respect to slowing curve data.

6. The method according to claim 5, which further comprises controlling at least one operating phase as follows based on the slowing curve data:

coasting phase, braking phase according to a first braking effect stage, or braking phase according to an at least second braking effect stage.

7. A method for operating a vehicle, the method comprising the following steps:

providing a vehicle having a drive unit, a driving-data determination unit, a consumer set and a power management unit for managing the consumer set;

using the driving-data determination unit to identify driving curve data;

controlling the drive unit based on the driving curve data;

using the power management unit to receive consumer data from the consumer set;

using the power management unit to determine anticipatory load profile data at least based on the consumer data;

transmitting identification data to the driving-data determination unit in accordance with the load profile data;

using the driving-data determination unit to identify the driving curve data in accordance with the identification data;

providing the consumer set with at least one charging unit for charging an energy storage device of the vehicle; and using the power management unit to receive energy status data from the energy storage device and to determine the anticipatory load profile data at least on a basis of the consumer data and the energy status data.

8. A method for operating a vehicle, the method comprising the following steps:

providing a vehicle having a drive unit, a driving-data determination unit, a consumer set and a power management unit for managing the consumer set;

using the driving-data determination unit to identify driving curve data;

controlling the drive unit based on the driving curve data;

using the power management unit to receive consumer data from the consumer set;

using the power management unit to determine anticipatory load profile data at least based on the consumer data;

transmitting identification data to the driving-data determination unit in accordance with the load profile data;

using the driving-data determination unit to identify the driving curve data in accordance with the identification data; and controlling the consumer set in accordance with the load profile data.

9. A method for operating a vehicle, the method comprising the following steps:

providing a rail-borne vehicle having a drive unit, a driving-data determination unit, a consumer set and a power management unit for managing the consumer set;

using the driving-data determination unit to identify driving curve data;

controlling the drive unit based on the driving curve data;

using the power management unit to receive consumer data from the consumer set;

using the power management unit to determine anticipatory load profile data at least based on the consumer data;

transmitting identification data to the driving-data determination unit in accordance with the load profile data;

using the driving-data determination unit to identify the driving curve data in accordance with the identification data.

10. A vehicle, comprising:

a driving-data determination unit for determining data sets including alternative driving curve data;

a drive unit configured to be controlled on a basis of the driving curve data;

a consumer set containing consumer data;

a power management unit for managing said consumer set;

a data connection between said power management unit and said consumer set enabling said power management unit to determine anticipatory load profile data at least based on the consumer data of said consumer set, to receive the data sets and to select one of the data sets in accordance with the load profile data;

a connection between said power management unit and said driving-data determination unit for transmitting identification data to said driving-data determination unit in accordance with the load profile data; and said driving-data determination unit identifying the driving curve data in accordance with the identification data and the identification data being characteristic of the selected data set.

11. The vehicle according to claim 10, wherein the vehicle is a rail-borne vehicle.

* * * * *